US008417496B2

(12) United States Patent
Main et al.

(10) Patent No.: US 8,417,496 B2
(45) Date of Patent: Apr. 9, 2013

(54) HYDROCARBON RECOVERY FROM A HYDROCARBON RESERVOIR

(75) Inventors: Ian Main, Edinburgh (GB); Lun Li, Edinburgh (GB); Orestis Papasouliotis, Geneva (CH); Thomas Leonard, Edinburgh (GB)

(73) Assignee: The University Court of the University of Edinburgh, Edinburgh (GB)

( * ) Notice: Subject to any disclaimer, the term of this patent is extended or adjusted under 35 U.S.C. 154(b) by 0 days.

(21) Appl. No.: 12/085,059

(22) PCT Filed: Nov. 24, 2006

(86) PCT No.: PCT/GB2006/004397

§ 371 (c)(1),
(2), (4) Date: Jan. 15, 2009

(87) PCT Pub. No.: WO2007/060446

PCT Pub. Date: May 31, 2007

(65) Prior Publication Data

US 2009/0125288 A1 May 14, 2009

(30) Foreign Application Priority Data

Nov. 26, 2005 (GB) ..... 0524134.4

(51) Int. Cl.

| | |
|---|---|
| ***G06F 17/50*** | (2006.01) |
| ***G06F 7/60*** | (2006.01) |
| ***G06F 17/10*** | (2006.01) |
| ***G06F 7/50*** | (2006.01) |
| ***G06G 7/48*** | (2006.01) |

(52) U.S. Cl. ..... 703/10; 703/1; 703/2; 703/9

(58) Field of Classification Search ..... 703/1, 2, 703/9, 10

See application file for complete search history.

(56) References Cited

U.S. PATENT DOCUMENTS

| | | | | |
|---|---|---|---|---|
| 4,969,130 | A * | 11/1990 | Wason et al. | 367/73 |
| 5,305,209 | A * | 4/1994 | Stein et al. | 702/13 |
| 6,101,447 | A * | 8/2000 | Poe, Jr. | 702/13 |
| 6,549,854 | B1 * | 4/2003 | Malinverno et al. | 702/16 |
| 7,369,979 | B1 * | 5/2008 | Spivey | 703/8 |
| 2002/0099505 | A1 * | 7/2002 | Thomas et al. | 702/12 |
| 2004/0254734 | A1 * | 12/2004 | Zabalza-Mezghani et al. | 702/13 |

OTHER PUBLICATIONS

See et al. "Optimal Reservoir Production Scheduling by Using Reservoir Simulation", Society of Petroleum Engineers of AIME, 1983.*

(Continued)

*Primary Examiner* — Shambhavi Patel
(74) *Attorney, Agent, or Firm* — Drinker, Biddle & Reath, LLP

(57) ABSTRACT

A computer system for modelling and controlling a hydrocarbon reservoir through management of fluid flow at individual wells. The computer system has program instructions which operate a computer model which uses oilfield production data to provide a model of future production. The model comprises an optimal regression model which represents injector and producer wells whose fluid flow characteristics are highly correlated with the fluid flow characteristics of the well of interest; the application of parsimonious information criterion techniques to identify well pairs that statistically contribute information to the optimal regression model; and a statistical reservoir model comprising the product of the optimal regression model and a significance matrix. The system is also provided with control means, responsive to the output of the computer model in order to control wells in the hydrocarbon reservoir.

19 Claims, 5 Drawing Sheets

OTHER PUBLICATIONS

Contento et al. "A Risk Analysis Approach: From Subsurface to Surface", 2005.*
White et al. "Identifying Controls on Reservoir Behavior using Designed Simulations", 2000.*
Peake et al. "Uncertainty Assessment using Experimental Design": Minagish Oolite Reservoir, 2005.*
Soleng, Harald. "Oil Reservoir Production Forecasting with Uncertainty Estimation Using Genetic Algorithms", 2001.*
Yue, Junpeng. "Water-Drive Gas Reservoir: Sensitivity Analysis and Simplified Prediction", Dec. 2002.*
Weiss, N. A., "*Elementary Statistics* ", 2nd Edition, 1993, p. 609.
Woosley. J., "ISO 14001 Section 4.3.1, Environmental Aspects"; *N.C. Division of Pollution Prevention and Environmental Assistance*, Franklintown, North Carolina, Oct. 9, 2001, slide presentation, 37 pages.

* cited by examiner

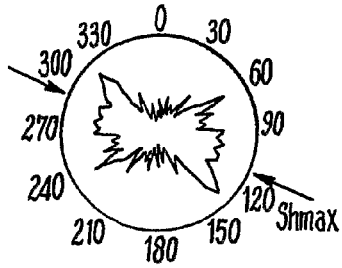
FIG. 5(iii)

HYDROCARBON RECOVERY FROM A HYDROCARBON RESERVOIR

The present invention relates to improvements in and relating to hydrocarbon oil and gas recovery from a hydrocarbon reservoir. In particular, the invention relates to systems including control systems which incorporate the modelling of hydrocarbon reservoirs using oilfield injection and production data to monitor, predict and manage the production of hydrocarbons and the maintenance of reservoirs.

Reservoirs of hydrocarbon fluids that make up an oilfield typically comprise a sub-surface body of rock of suitable porosity to allow the storage and transmittal of fluids. Injection and producer wells are sunk into the reservoir to allow the hydrocarbon fluids to be extracted. The primary purpose of the injection well is to maintain the pressure within the reservoir by injecting predetermined amounts of fluid to create a positive pressure that will allow the hydrocarbon fluid to be easily extracted. A reservoir may have 50 injection and producer wells sunk, each of which provide an input to or an output from the reservoir.

It is desirable to maximise control over the injection and producer wells. However, the large number of inputs/outputs to the reservoir, as well as the complex geology and geophysics of the reservoir make it extremely difficult to predict the response of the reservoir and the injection and producer wells to changes to the reservoir.

It is known that individual producers in an oilfield under water flood can have a strong sensitivity to individual injectors, that is, injection of fluid from a particular injector can have a disproportionate effect on production. In addition, the strongest sensitivity to individual injectors is directionally associated with the stress state and has a long-range nature. In some cases, patterns of sensitivity that resemble the faulting patterns in the field have been observed. The most likely explanation of these effects is that the systems of faults and fractures and the stress field acting on them are in, or close to, a critical state where poro-elastic stress disturbances caused by fluctuations in fluid flow rates influence their individual conductivities. Complex patterns, strong susceptibility to disturbances and long-range correlations are characteristic of many physical systems at a critical point.

Particular systems with many degrees of freedom that are far from equilibrium, and are continuously subjected to input of energy which is then dissipated through the system, can self-organize to a point of criticality without external tuning of the relevant parameters. Perturbations to their natural state caused by field development processes will then also be likely to self-organize.

The method of using correlations to predict future performance in a complex non-linear system has been applied in the banking and insurance industries for many years. For example, predictions of flood or hurricane frequency for the next year, based on key weather indicators in the present year, have been used to help determine insurance premiums. These statistical or 'heuristic' models are always applied with references to a more physical model or previous experience, and are rarely used on their own to predict future trends.

Alternative, much simpler correlation techniques have previously been used in oilfield management, initially as a means of determining if the local stress field had an impact on oilfield production rates. Heffer et al. (1997) used the Spearman rank correlation method to examine the directionality of the correlation with respect to the maximum horizontal stress field. The results showed a strong alignment of the direction of the correlation in stacked data in all eight test cases tested. The main advantage of the Spearman rank correlation method over traditional least-squares regression is that it can establish if a correlation exists. Its main disadvantage is that it cannot then place accurate statistical bounds on the uncertainties in the parameters, and hence cannot be used to directly extract a quantitative statistical reservoir model that can be used to predict the response of the reservoir to a given change in injection or production strategy.

Therefore, it is desirable to develop new methods to establish accurate predictive correlations between flow rates at injector and producer well pairs. This will provide new information that can be used either to confirm physically based reservoir model, or to suggest areas where they do not capture elements of the response of the reservoir.

It is an object of the invention to predict oilfield performance on a timescale of a few months, in order for example, to assist with planned fluid injection strategies, or to optimise forced maintenance and repair schedules.

It is a further object of the present invention to provide an apparatus and method for improving hydrocarbon recovery, based on analysing flow rate data in oilfield producer and injector wells.

In accordance with a first aspect of the invention there is provided a computer system for modelling hydrocarbon reservoir behaviour to manage fluid flow within the reservoir, the computer system comprising:

an analysis module analysing oil field production data by executing program instructions which comprise an optimal regression model which represents injector and producer wells whose fluid flow characteristics are highly correlated with the fluid flow characteristics of the well of interest;

executing program instructions which apply parsimonious information criterion techniques to identify well pairs that are statistically contribute information to the optimal regression model;

executing program instructions which obtain a statistical reservoir model comprising the product of the optimal regression model and a significance matrix; and control means for controlling the one or more wells of interest to manage fluid flow in response to the statistical reservoir model of the analysis module.

The computer system may manage fluid flow in the reservoir by modifying flow at on or more walls of interest.

Preferably, the control means controls the throughput of one or more wells.

Preferably, the control means controls the sweep or pattern of injection into an injector well.

Preferably, the control means is adapted to identify the position of in-fill wells.

Preferably, the control means is adapted to automatically control the one or more wells.

Preferably, the control means is adapted to control the injection of fluid into a reservoir.

Preferably, the fluid is water or carbon dioxide.

Preferably, the parsimonious information techniques comprise Bayesian techniques.

Preferably, the significance matrix is a binary significance matrix.

Preferably, a multiple linear regression model is utilised to establish the optimal regression model for injector and producer wells.

Preferably, the multiple linear regression model;

(a) defines a predictive mean squared error model for a predetermined lag time;

(b) minimizes the predictive mean squared error to obtain a formal multiple linear regression model;

(c) searches for the optimal regression model by a proposed best model selection strategy, wherein the strategy is an automatic forward searching of the model space in a targeted way through all possible well pairs, using a modified Bayesian Information Criterion (BIC); and (d) obtains the optimal regression model when the (a) $R^2$ exceeds a given value while BIC is still increasing (b) $R^2$ is decreasing or (c) a given number of iterations is reached.

Preferably, the time lag is a one-month time lag. Other time lags of injector wells and producer wells may be used, including zero lag.

Preferably, the optimal regression model is determined from a form of the multiple linear regression models, wherein a best model selection strategy is designed for automatic searching of a model space in a targeted way to compare different models using a modified Bayesian Information Criterion (BIC). For small reservoirs with few injectors the Akaike Information Criterion (AIC) may be preferable.

Preferably, the model with the largest BIC value and the increased coefficient of determination ($R^2$) simultaneously are selected.

Preferably, a full Bayesian analysis is applied to a Bayesian Dynamic Linear Model (DLM), based on Markov Chain Monte Carlo (MCMC) methods, wherein the DLM has the same predictors as the ones identified in the optimal regression model.

Preferably, the full Bayesian analysis further comprises:

(a) defining the Bayesian DLM, wherein the DLM model has the same predictors as the ones identified in the optimal regression, with the corresponding error terms mutually independent and normally distributed with zero mean and finite variances;

(b) applying a prior distribution assumption for unknown parameters for the DLM model where the corresponding variances possess chi-squared distributions;

(c) applying a likelihood function of the unknown parameters;

(d) calculating the joint posterior densities of the unknown parameters;

(e) calculating the corresponding full conditional densities of each parameter in the models;

(f) applying a Gibbs sampler algorithm to obtain the full posterior densities of the unknown parameters in a straightforward way; and (g) obtaining the significance matrix by the posterior density of slope coefficient that if the posterior density of slope coefficient is centred at zero, then the coefficient most probably be zero, otherwise the coefficient is one.

The significance matrix may be a binary array of ones and zeros.

Preferably, the proposed Bayesian DLM is related to a quadratic growth model, in which the error terms correspond to level, growth and change of growth of the underlying process of pressures at time t.

Preferably, assumptions for the error terms are mutually independent and normally distributed with zero mean and finite variance.

Preferably, the reduced DLM models are obtained if some of the variance components are found to equal zero.

Preferably, Gibbs sampling and a MCMC scheme for simulation, provides full conditional posterior densities of the full unknown parameters.

Preferably, the optimal regression model obtained from the multiple linear regression model is a real matrix.

Preferably, the significance matrix obtained from the full Bayesian analysis is a binary matrix.

Preferably, the statistical reservoir model is obtained from the product of the real regression matrix and the binary significance matrix.

The optimal regression model matrix is an array of real numbers at one or more different time lags, and the significance matrix from the Bayesian analysis is a binary array of ones and zeros for the same well pairs at the same time lags.

The present invention provides a new optimal model selection strategy which automatically searches through all possible well pairs in a targeted way using a modified Bayesian Information Criterion (BIC) to determine the significance, combined with the coefficient of determination ($R^2$) as a stopping criterion.

The Bayesian Dynamic Linear Model (DLM) establishes the corresponding binary significance matrix, using a full Bayesian analysis approach based on Markov Chain Monte Carlo methods. The full Bayesian analysis diminishes the likelihood of chance correlations contaminating the predictive power.

The present invention can be used either to validate a conventional reservoir model, or in heuristic mode to predict the reservoir response to planned field developments such as increased injection rate, organised 'sweep' or shut-downs for maintenance.

The present invention is also able to assess the likelihood of 'chance' correlations contaminating the predictive power, the most serious potential problem in any heuristic statistical model. The methods should be able to expose the general nature, and help with identifying the underlying cause, of the correlations between time series for flow rate between injector and producer well pairs.

The invention may use a multiple linear regression model to establish the optimal regression model of well pressures from oilfield production data. It then obtains the corresponding binary significance matrix by applying the full Bayesian analysis approach to the proposed Bayesian Dynamic Linear Model (DLM) via Markov Chain Monte Carlo (MCMC) methods. As illustrated in FIG. 1, the statistical reservoir model 6 is the product of the individual elements of optimal regression model 2 (an array of real numbers) and the significance matrix 4 (a binary array of ones and zeroes) rather than a standard matrix multiplication. The concept of a statistical reservoir model is illustrated in FIG. 1. If the statistical reservoir model is constructed for a single time lag, it will take the form of a two-dimensional matrix.

Future production rates $P_j$ at time t+1 for the j'th producer are predicted by regression from past and present flow rates at the i'th injector $I_i$ or producer $P_i$ at times t, t-1, t-2, . . . . FIG. 2 shows a matrix multiplication that illustrates this prediction for the case of a single time lag L=1 with production rate 10 $P_j$ and flow rates 8.

The results of the present invention assist in optimising hydrocarbon productivity on the time scale of a few months, for example, for daily production operations as a guide to managing individual well rates, by providing more accurate forecasts of future production rates. Further, the present invention may automatically update the set of inter-well rate correlations for a field and provide a set of (short-term) optimum well rates for guidance to the production supervisor.

The present invention is complementary to traditional reservoir modelling which is based on a detailed reservoir description and fluid flow simulation. In particular it can be used as a possible screening method for determining when geo-mechanical simulations are necessary (to account for long-range correlation) or normal drainage (Darcy flow) is sufficient.

The present invention will now be described by way of example only with reference to the accompanying drawings in which.

Figure 5I:
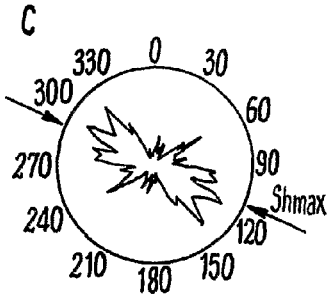
Figure 5:
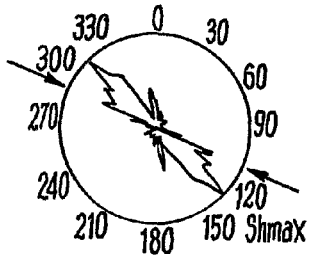
Figure 9:
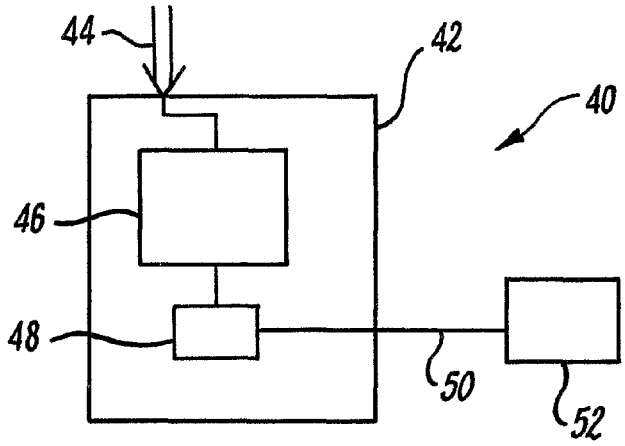
Figure 6:
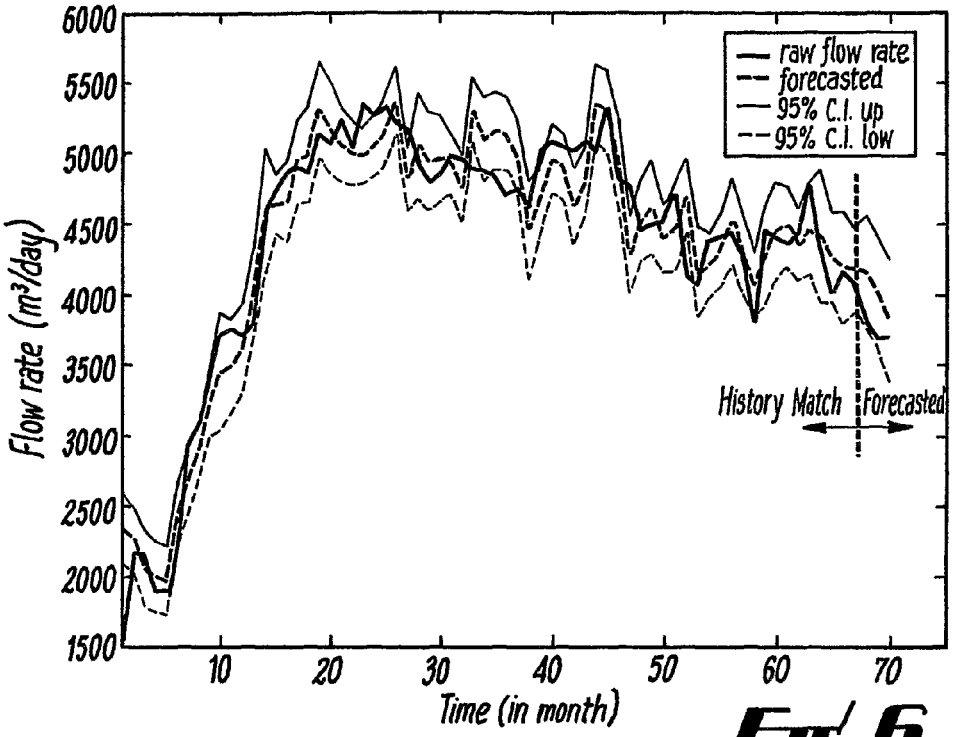
Figure 7:
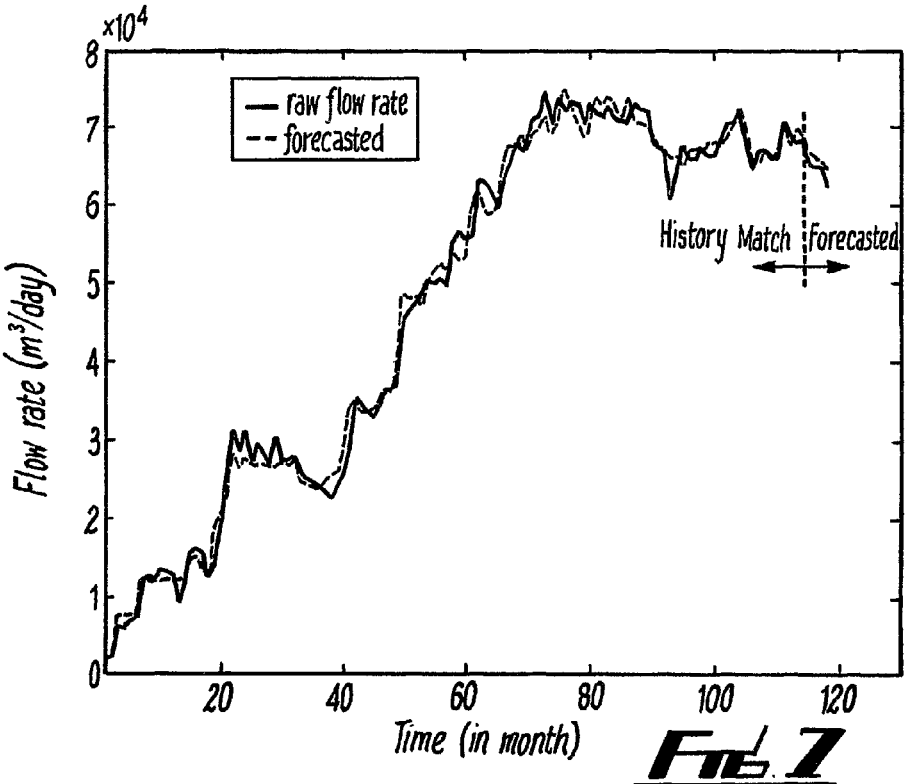
Figure 8:
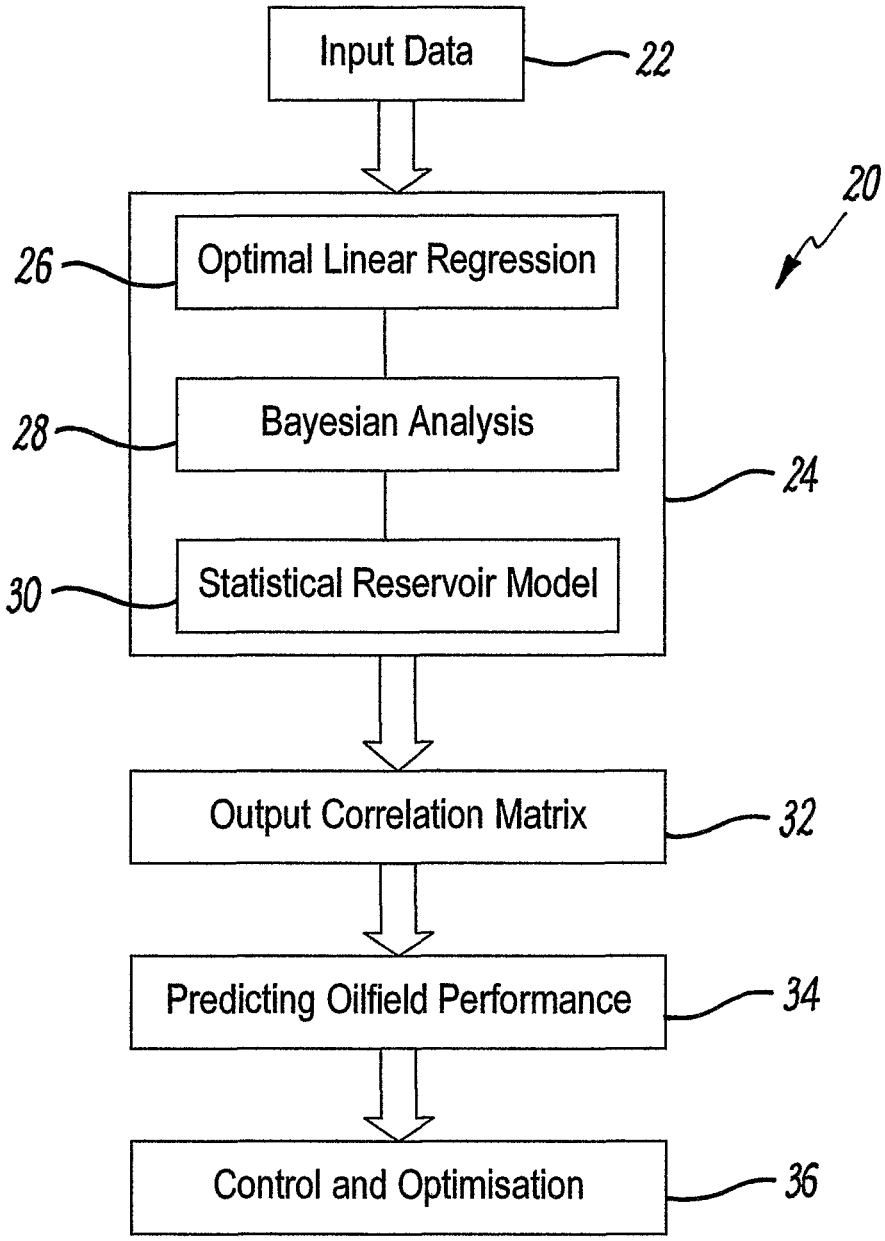

FIGS. 5(*i*) to (*iii*) are Rose diagrams of the orientation distribution of significantly-correlated well pairs for different zones in the oil field;

FIG. 6 is a graph of flow rate versus time using the present invention to predict flow rate for a single well;

FIG. 7 is a graph of flow rate versus time using the present invention to predict flow rate for a group of wells;

FIG. 8 shows a general arrangement in which the computer system of the present invention is used to characterise and control the operation of an oil field; and FIG. 9 shows a computer system in accordance with the present invention.

Raw oilfield production data composed of monthly averaged measurements of flow rate (normally, volume in barrels or $m^3$ per month) taken over a period of months are used. Where data permit, higher sampling rates are also available. The flow rates are proportional to the well pressure.

For injector wells, the input data are the total flow rates of water and/or gas or other fluids injected into the subsurface. For producer wells, they are the total flow rate. The present invention applies to total flow rate, but it is also possible to predict based on a breakdown to relevant proportions of oil, gas and water at producers.

It is possible, for each well, that there is some data missing due to maintenance, insufficient data recording and/or other reason. In addition, a number of wells are operated as both producers and injectors, during some months for production and during other months for water and/or gas injection.

For all subsequent calculations, each well time series are first normalised to have sample mean 0 and standard deviation 1 to enable a direct comparison.

The mathematical basis of at least one embodiment of the computer system of the present invention will now be described.

A Predictive Mean Squared Error Model

Figure 1:
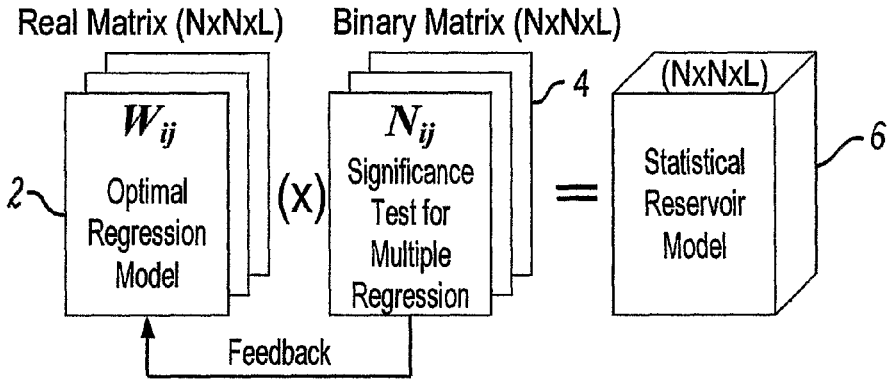
FIG. 1 shows schematically, features of a statistical reservoir model used in a computer system in accordance with the invention.
Figure 2:
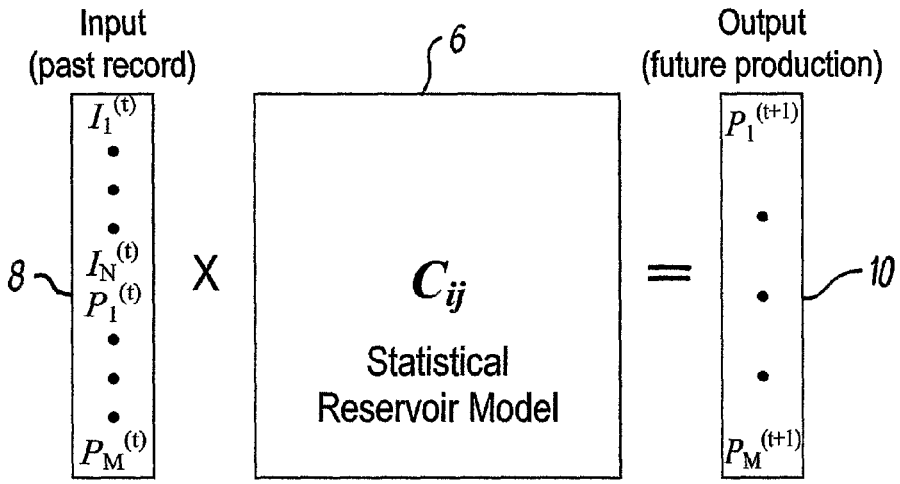
FIG. 2 shows the relationship between the input, output and the statistical reservoir model.

In order to identify producer and injector wells whose pressures are highly correlated with the pressure of a chosen producer well of interest, the proposed model can be expressed in the form of a predictive mean squared error as:

$$\sum_{t=2}^{n}(y_t - \beta_1^T X_{t-k} - \beta_2^T Y_{t-K})^2 = 0, \tag{1}$$

Where $x_{t-k}$ is the vector of injection at selected wells at time t−k, where k(>=0) is the lag time, and $y_{t-k}$ is the vector of production at selected wells at time t−k, including possibly the chosen producer well at time t−k, and $\beta_1$ and $\beta_2$ are unknown vector parameters. In equation (1), the model would be a two-dimensional matrix, but can be extended to include several lag times k, resulting instead in a three-dimensional array (FIG. 1). This general model can be modified according to the possible optimal lag times, for example possibly including further lags of injectors and producers or less terms considering in (1).

Multiple Linear Regression Model

The minimisation of model (1) leads the form of a multiple linear regression as follow:

$$y_t = \beta_1^T x_{t-k} + \beta_2^T y_{t-k},\ t=2, \ldots, n, \tag{2}$$

Hence the solution of the model (1) leads to solving a multiple linear regression problem in (2).

When the relationship between a variable of interest and a subset of potential predictors is to be modelled, there is uncertainty about which subset to use because of many redundant or/and irrelevant predictors.

Model selection criteria play an important role in the model selection methods. The Bayesian information criterion (BIC) is one of the most popular criteria for selection models. The BIC is motivated by the Bayesian idea that will select the model with the largest posterior probability, and that better for large data sets such as the ones considered here. A modified BIC criterion below is suitable to identify good predictors.

Modified BIC Criterion

The modified BIC criterion to compare different models is written in a normalised version of BIC as:

$$BIC = -\log 2\pi - \log\left(\frac{S_R^2}{N}\right) - 1 - \frac{k}{N}\max\left\{\log\left(\frac{N}{2\pi}\right), 2\right\} \tag{3}$$

where k is the number of estimated parameters and $S_R^2$ is the standard residual sum of squares. When $\log[N/(2\pi)]<2$, we have the AIC (Aikaike's information criterion) and when $\log[N/(2\pi)]>2$ we have the standard BIC. From this pragmatic criterion, we can obtain a value of BIC per observation and can compare models with different data sets by selecting the model with the highest criterion value.

Best Model Selection Strategy

The total number of possible models is very large. In a regression with 50 predictors, there will be $1.1259\times10^{15}$ possible models to consider. Thus, a strategy was designed for searching such a large space of models. The proposed best model selection strategy, called a targeted search, is to automatically search the model space in a targeted way through all possible well pairs, using the modified BIC criterion. This has the advantage of drastically reducing the computational time needed. Wherein it uses an automatic parallel forward search of all possible models in the model space to compare different models using BIC criterion defined in formula (3), to select the predictor with the largest BIC value and the increased coefficient of determination ($R^2$) simultaneously. It is this novel selection strategy that makes the concept of a statistical reservoir model for a whole oilfield a practical proposition.

The detailed strategy can be described as below:

At each step, for all wells (injectors, producers and their optimal month lagged values), select the best predictor which will produce the maximised BIC in (3) and simultaneously an increase in $R^2$. The stopping rule is when (a) $R^2$ exceeds a given value while BIC is still increasing (b) $R^2$ is decreasing or (c) a given number of iterations is reached.

Bayesian Analysis of the DLM

This section presents a methodology of Bayesian analysis of the proposed DLM for establishing the statistical reservoir model. The proposed Bayesian dynamic linear model (DLM) is related to a quadratic growth dynamic linear model, wherein which has the same predictors as the ones identified in the optimal regression model. The aim of the full Bayesian analysis is to confirm the significant correlations observed in the optimal regression model. The stopping rule is when Bayesian Dynamic Linear Model The proposed Bayesian DLM can be written as:

$$y_t = x_t^T\beta + \theta_t + \epsilon_t \tag{4}$$

$$\theta_t = \theta_{t-1} + b_t + \eta_t \tag{5}$$

$$b_t = b_{t-1} + h_t + \alpha_t \tag{6}$$

$$h_t = h_{t-1} + \zeta_t \tag{7}$$

for t=1, 2, . . . , N, with the error terms $\epsilon_t$, $\eta_t$, $\alpha_t$ and $\zeta_t$ mutually independent and normally distributed with mean 0 and variances $V_\epsilon$, $V_\eta$, $V_\alpha$ and $V_\zeta$, respectively. In addition, let us also assume $\theta_0$, $b_0$ and $h_0$ to be mutually independent and normally distributed with mean 0 and separately variances $\mu_\eta V_\eta$, $\mu_\alpha V_\alpha$ and $\mu_\zeta V_\zeta$, with the specified $\mu_\eta$, $\mu_\alpha$ and $\mu_\zeta$.

This model is related to the quadratic growth dynamic linear model studied by West and Harrison (1997), but with the additional regression terms in (4) and unknown variances $V_\epsilon$, $V_\eta$, $V_\alpha$ and $V_\zeta$. The pressure of well i at time t depends on the past and current pressures of some good predictor wells by the regression function $x_t^T\beta$ and the growth of underlying process $\theta_t$, $b_t$ and $h_t$ that are correspond to level, growth and change of the growth with the corresponding observational error $\epsilon_t$.

Likelihood

The likelihood of the slope vector, β, and the four variance components, $V_\epsilon$, $V_\eta$, $V_\alpha$ and $V_\zeta$ is:

$$\begin{aligned} p(y_t, \theta_t, b_t, h_t \mid \beta, V_\varepsilon, V_\eta, V_\alpha, V_\zeta) == \\ (2\pi V_\varepsilon)^{-N/2}\exp\left\{-\frac{1}{2}V_\varepsilon^{-1}\sum_{t=1}^{N}(y_t - x_t^T\beta - \theta_t)^2\right\}\times(2\pi V_\eta)^{-N/2} \\ (2\pi\mu_\eta V_\eta)^{-1/2}\exp\left\{-\frac{1}{2}V_\eta^{-1}\sum_{t=1}^{N}(\theta_t - \theta_{t-1} - b_t)^2 - \frac{1}{2}\mu_\eta^{-1}V_\eta^{-1}\theta_0^2\right\}\times \\ (2\pi V_\alpha)^{-N/2}(2\pi\mu_\alpha V_\alpha)^{-1/2}\exp \\ \left\{-\frac{1}{2}V_\alpha^{-1}\sum_{t=1}^{N}(b_t - b_{t-1} - h_t)^2 - \frac{1}{2}\mu_\alpha^{-1}V_\alpha^{-1}b_0^2\right\}\times(2\pi V_\zeta')^{-N/2} \\ (2\pi\mu_\zeta V_\zeta)^{-1/2}\exp\left\{-\frac{1}{2}V_\zeta^{-1}\sum_{t=1}^{N}(h_t - h_{t-1})^2 - \frac{1}{2}\mu_\zeta^{-1}V_\zeta^{-1}h_0^2\right\} \end{aligned} \tag{8}$$

Posterior Distribution

We assume:

The slope vector β and the four variance components, $V_\epsilon$, $V_\eta$, $V_\alpha$ and $V_\zeta$ are independent, β is normally distributed with mean $\beta_0$ and covariance matrix C, the prior distribution of the four variances, $\omega_1\lambda_1/V_\epsilon$, $\omega_2\lambda_2/V_\eta$, $\omega_3\lambda_3/V_\alpha$, and $\omega_4\lambda_4/V_\zeta$ possess chi-squared distributions with $\omega_1$, $\omega_2$, $\omega_3$ and $\omega_4$ degrees of freedom, respectively.

The joint posterior density of the $\theta_t$, $b_t$ and $h_t$, the vector of slopes and the four variances can be written as:

$$\begin{aligned} \pi(\theta_t, b_t, h_t, \beta, V_\varepsilon, V_\eta, V_\alpha, V_\zeta \mid y_t) \propto \\ p(y_t, \theta_t, b_t, h_t \mid \beta, V_\varepsilon, V_\eta, V_\alpha, V_\zeta)\pi(\beta, V_\varepsilon, V_\eta, V_\alpha, V_\zeta) \propto \end{aligned} \tag{9}$$

-continued $$\begin{aligned} p(y_t, \theta_t, b_t, h_t \mid \beta, V_\varepsilon, V_\eta, V_\alpha, V_\zeta)|C|^{-1/2}\exp \\ \left\{\frac{1}{2}(\beta-\beta_0)^T C^{-1}(\beta-\beta_0)\right\}\times V_\varepsilon^{-\frac{1}{2}(\varpi_1+2)}\exp\left(-\frac{1}{2}V_\varepsilon^{-1}\omega_1\lambda_1\right) \\ V_\eta^{-\frac{1}{2}(\varpi_2+2)}\exp\left(-\frac{1}{2}V_\eta^{-1}\omega_2\lambda_2\right)\times V_\alpha^{-\frac{1}{2}(\varpi_3+2)} \\ \exp\left(-\frac{1}{2}V_\alpha^{-1}\omega_3\lambda_3\right)V_\zeta^{-\frac{1}{2}(\varpi_4+2)}\exp\left(-\frac{1}{2}V_\zeta^{-1}\omega_4\lambda_4\right) \end{aligned}$$

The above joint posterior density can be used to obtain the full conditional densities of each its parameters, and subsequently to obtain the posterior density using the Gibbs sampler.

According to the Gibbs sampler algorithm, the posterior distribution of the unknown parameters can be generated from the full conditional distributions when the Markov chain has a stationary distribution.

To implement the Gibbs sampler algorithm, we need the conditional posterior distributions.

Full Conditional Distributions

Conditionally upon the data, and all other unknown random variables and parameters in the model, we make the following statements:

A1: $\theta_0$ is normally distributed with mean $\theta_0$*, where $$\theta_0^* = (1+\mu_\eta^{-1})^{-1}(\theta_1 - b_1) \tag{10}$$

and variance $V_\eta(1+\mu_\eta^{-1})^{-1}$.

A2: For t=1, 2, . . . , N−1, $\theta_t$ is normally distributed with mean $\theta_t$*, where $$\theta_t^* = (V_\epsilon^{-1}+2V_\eta^{-1})^{-1}\{V_\epsilon^{-1}(y_t - x_t^T\beta) + V_\eta^{-1}(\theta_{t-1}+\theta_{t+1}+ b_t - b_{t+1})\} \tag{11}$$

and variance $(V_\epsilon^{-1}+2V_\eta^{-1})^{-1}$.

A3: $\theta_N$ is normally distributed with mean $\theta_N$*, where $$\theta_N^* = (V_\epsilon^{-1}+V_\eta^{-1})^{-1}\{(y_N - x_N^T\beta) + V_\eta^{-1}(\theta_{N-1}+b_N)\} \tag{12}$$

and variance $(V_\epsilon^{-1}+V_\eta^{-1})^{-1}$.

A4: $b_0$ is normally distributed with mean $b_0$*, where $$b_0^* = (1+\mu_\alpha^{-1})_{-1}(b_1 - h_1) \tag{13}$$

and variance $V_\alpha(1+\mu_\alpha^{-1})^{-1}$.

A5: For t=1, 2, . . . , N−1, $b_t$ is normally distributed with mean $b_t$*, where $$b_t^* = (V_\eta^{-1}+2V_\alpha^{-1})^{-1}\{V_\eta^{-1}(\theta_t - \theta_{t-1}) + V_\alpha^{-1}(b_{t-1}+b_{t+1}+ h_t - h_{t+1})\} \tag{14}$$

and variance $(V_\eta^{-1}+2V_\alpha^{-1})^{-1}$.

A6: $b_N$ is normally distributed with mean $b_N$*, where $$b_N^* = (V_\eta^{-1}+V_\alpha^{-1})^{-1}\{V_\eta^{-1}(\theta_N - \theta_{N-1}) + V_\alpha^{-1}(b_{N-1}+h_N)\} \tag{15}$$

and variance $(V_\eta^{-1}+V_\alpha^{-1})^{-1}$.

A7: $h_0$ is normally distributed with mean $h_0$*, where $$h_0^* = (1+\mu_\zeta^{-1})^{-1}h_1 \tag{16}$$

and variance $V_\zeta(1+\mu_\zeta^{-1})^{-1}$.

A8: For t=1, 2, . . . , N−1, $h_t$ is normally distributed with mean $h_t$*, where $$h_t^* = (V_\alpha^{-1}+2V_\zeta^{-1})_{-1}\{V_\alpha^{-1}(b_t - b_{t-1}) + V_\zeta^{-1}(h_{t-1}+h_{t+1})\} \tag{17}$$

and variance $(V_\alpha^{-1}+2V_\zeta^{-1})^{-1}$.

A9: $h_N$ is normally distributed with mean $h_N$*, where $$h_N^* = (V_\alpha^{-1}+V_\zeta^{-1})_{-1}\{V_\alpha^{-1}(b_N - b_{N-1}) + V_\zeta^{-1}h_{N-1}\} \tag{18}$$

and variance $(V_\alpha^{-1}+V_\zeta^{-1})^{-1}$.

A10: For the variance $V_\epsilon$, the quantity $(\omega_1+N)V_\epsilon^*/V_\epsilon$ has a chi-squared distribution with $\omega_1$+N degree of freedom, where $$V_\varepsilon^* = \left\{\omega_1\lambda_1 + \sum_{t=1}^{N}(y_t - x_t^T\beta - \theta_t)^2\right\} \Big/ (\omega_1 + N). \tag{19}$$

A11: For the variance $V_\eta$, the quantity $(\omega_2+N+1)V_\eta^*/V_\eta$ has a chi-squared distribution with $\omega_2+N+1$ degree of freedom, where $$V_\eta^* = \left\{\omega_2\lambda_2 + \sum_{t=1}^{N}(\theta_t - \theta_{t-1} - b_t)^2 + \mu_\eta^{-1}\theta_0^2\right\} \Big/ (\omega_2 + N + 1). \tag{20}$$

A12: For the variance $V_\alpha$, the quantity $(\omega_3+N+1)V_\alpha^*/V_\alpha$ has a chi-squared distribution with $\omega_3+N+1$ degree of freedom, where $$V_\alpha^* = \left\{\omega_3\lambda_3 + \sum_{t=1}^{N}(b_t - b_{t-1} - h_t)^2 + \mu_\alpha^{-1}b_0^2\right\} \Big/ (\omega_3 + N + 1). \tag{21}$$

A13: For the variance $V_\xi$, the quantity $(\omega_4+N+1)V_\xi^*/V_\xi$ has a chi-squared distribution with $\omega_4+N+1$ degree of freedom, where $$V_\xi^* = \left\{\omega_4\lambda_4 + \sum_{t=1}^{N}(h_t - h_{t-1})^2 + \mu_\xi^{-1}h_0^2\right\} \Big/ (\omega_4 + N + 1). \tag{22}$$

A14: The vector $\beta$ is normally distributed with mean $\beta^*$, where $$\beta^* = \left(V_\varepsilon^{-1}\sum_{t=1}^{N}x_t x_t^T + C^{-1}\right)^{-1}\left(V_\varepsilon^{-1}\sum_{t=1}^{N}x_t x_t^T\hat{\beta} + C^{-1}\beta_0\right) \tag{23}$$

and variance $$\left(V_\varepsilon^{-1}\sum_{t=1}^{N}x_t x_t^T + C^{-1}\right)^{-1}.$$

Since all of these full conditional distributions are available, implementation of the Gibbs sampler for sampling the $\theta_t$, $b_t$, $h_t$, the vector of slopes $\beta$ and the four variances from A1-A14 is straightforward.

Two Reduced Models

If some of the variance components equal to zero, the proposed DLM can produce two reduced models.

(1) Linear Growth Dynamic Linear Model

If $V_\xi=0$, then all $h_t$ are zero. Therefore, we can obtain the reduced linear growth dynamic linear model plus the regression terms from formulations (4), (5) and (6), that can be expressed as:

$$y_t = x_t^T\beta + \theta_t + \epsilon_t \tag{24}$$

$$\theta_t = \theta_{t-1} + b_t + \eta_t \tag{25}$$

$$b_t = b_{t-1} + \alpha_t \tag{26}$$

The corresponding full conditional posterior densities can be obtained from A1-A6, A10-A12 and A14, with $h_t=0$, for t=1, 2, . . . , N.

(2) Two-Stage Markovian Model

If further $V_\alpha=0$, then all $h_t$ and $b_t$ are all zero. The reduced model is the two-stage Markovian model (Leonard and Hsu, 1999, p. 233) with superimposed random noise plus the regression terms as below:

$$y_t = x_t^T\beta + \theta_t + \epsilon_t \tag{27}$$

$$\theta_t = \theta_{t-1} + \eta_t \tag{28}$$

The corresponding full conditional posterior densities can be obtained from A1-A3, A10, A11 and A14, with $b_t=0$, for t=1, 2, . . . , N.

Significance Matrix

The full Bayesian analysis of the proposed DLM can be performed under the three sets of priors for the variance components to establish the corresponding significance matrix. For the priors chosen:

(1) $\omega_i=-2$ and $\lambda_i=0$, i=1, . . . , 4

(2) $\omega_i=5$ and $\lambda_i=0.5$, i=1, . . . , 4

(3) $\omega_i=3$ and $\lambda_i=0.1$, i=1, . . . , 4

In addition, we set $\mu_\eta=\mu_\alpha=\mu_\xi=2$. For the slope vector $\beta$, we assume always the same prior with mean zero and diagonal covariance matrix with the variances all equal to 10.

The corresponding posterior densities are stable under the three different models after 50,000 iterations of burn-in.

In addition, the significance matrix can be obtained by the rule: posterior density of slope coefficient centered at zero most probably means a coefficient of zero. If a predictor is found to be good in the optimal regression model, as well as in the full Bayesian analysis of the DLM, then this indicates that this predictor is statistically significant. Therefore, for the significance matrix, the statement is made upon the matrix of the significance test $N_{ij}=1$ if the predictor is statistically significant. Otherwise, the statement $N_{ij}=0$.

In the present invention, a statistical reservoir model is the product of the optimal regression and the significance matrix shown in FIG. 1. The optimal regression model of well pressures is a real matrix that presents injector and producer wells whose pressures are highly correlated with the pressures of a given producer well of interest based on the multiple linear regression, using the modified BIC criterion and proposed best model selection strategy. The corresponding significance matrix is a binary matrix that represents whether a predictor is statistically significant or not, based on the full Bayesian analysis of the proposed Dynamic Linear Model (DLM).

An example of the use of the present invention in characterizing a hydrocarbon reservoir will now be described. The example will model the subsurface response to changes in the output or input from producer or injector wells.

Firstly, the prediction error between the observed fluid flow rate $y_{i,t}$ at the i'th producer for times t=2, . . . , T is minimized as is that predicted, $\hat{y}_{i,t}$ by multiple regression on a vector $X_{t-k}$ of elements comprising the flow rates $x_{j,t-k}$ at all N producers and M injectors at time t−k, where k is a lag time.

$$\sum_{t=2}^{T}\sum_{i=1}^{N}(y_{i,t} - \hat{y}_{i,t})^2. \tag{29}$$

The solution to (29) for all $y_{i,t}$, is the Statistical Reservoir Model $$\hat{Y}_t = R_k X_{t-k} \tag{30}$$

where $\hat{Y}_t$ is a vector of predicted flow rates at all N producers and $R_k$ is a matrix of the regression parameters. For more than one time lag $R_k$ would be a three-dimensional array with elements $r_{i,j,k}$: i=1, . . . , N; j=1, . . . , N+M; k=1, . . . , K.

The inversion for the optimal Statistical Reservoir Model is done in two steps. Firstly, the well pairs that are significantly correlated at different lag times are identified using a modified Bayesian Information Criterion (BIC). This removes well pairs that do not significantly contribute information. Pragmatically, the search is stopped for a given producer when (a) $R^2$ exceeds a given value while BIC is still increasing (b) $R^2$ is decreasing or (c) a given number of iterations is reached. Second, Bayesian Dynamic Linear Modelling is used to eliminate a lower number of pairs whose optimal regression slope is not significantly different from zero.

These two steps together define a binary significance matrix, $S_{ij}$, where most elements are zero, resulting in a parsimonious model. Typically only 5-25 out of the 106 wells in a test case field are needed to achieve $R^2$=0.99 for a given producer.

Data were provided as monthly averages and treated as time series. For those well pairs identified as significant, $S_{ij}$=1, the optimal regression model $R_{ij}$ was calculated using (29).

Optimal time lags of k=0 and k=1 month were determined by examining the goodness of fit of the resulting time series.

These timescales reveal both a direct (instantaneous) effect, consistent with the poroelastic mechanism for stress transfer on fluid injection or withdrawal, and a time dependent effect of the order of one or a few months, the latter similar to that seen in earthquake aftershock sequences or induced seismicity.

Figure 3:
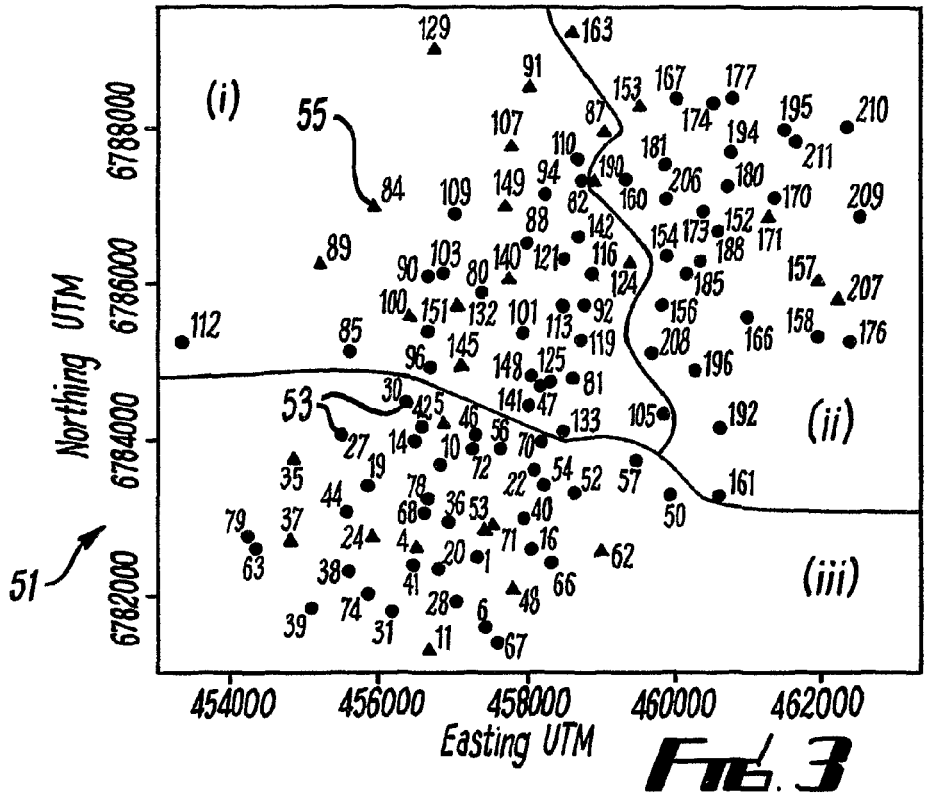
FIG. 3 is a map 51 which shows the location of numbered producers 53 (circles) and injectors (triangle) for an example oil field.

FIG. 3 is a map 51 which shows the location of numbered producers 53 (circles) and injectors 55 (triangles) in an oilfield, subdivided into three regions associated with platforms (i), (ii), and (iii).

Figure 4:
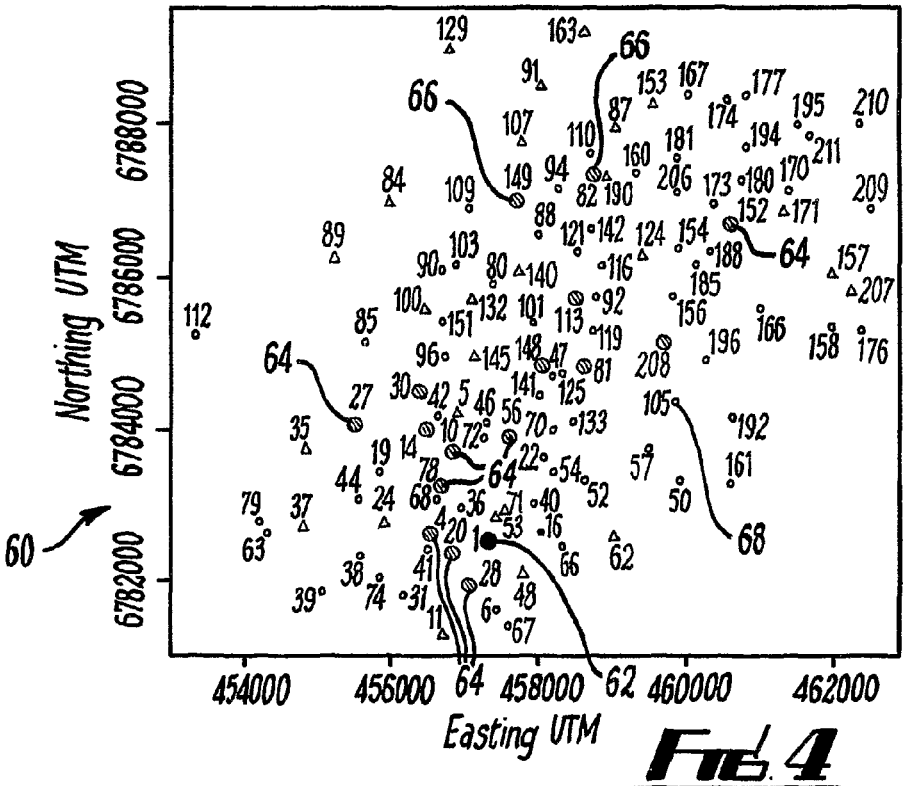
FIG. 4 is a map which shows the location of significantly correlated wells to a given producer in an oil field.

FIG. 4 is a map 60 which shows the location of significantly correlated wells in the oil field. The map 60 identifies the well of interest 62, significantly correlated wells (all 64 of which are denoted by the large shaded circle and other wells 68, denoted by the small circle. A number of the significantly correlated wells 64 are located near the well of interest 62. In addition, a long range correlation to wells 66 is also shown.

FIGS. 5(*i*) to (*iii*) are Rose diagrams of the orientation distribution of significantly-correlated well pairs for zones each compared with the orientation of the regional maximum horizontal principal stress.

FIGS. 6 and 7 are graphs of flow rate versus time for a single well (FIG. 6) and multiple wells (FIG. 7) for historical data and forecasted production. In both figures, an accurate forecast of flow rate within the calculated uncertainty is obtained using the present invention.

The computer system of the present invention is adapted to control performance of the wells in a field in response to the predicted effect of a change or perturbation caused by the operation of a well.

The present invention opens up the possibility of a new methodology of operating oil and gas fields world-wide. Unlike other systems that depend on an image of oilfield structure, it utilises the rate of flow at injection and production wells. Since virtually all hydrocarbon fields collect such data, the method has almost universal potential for application. The method can be used to explain past performance of the reservoir (in history matching mode) or to predict the response of the reservoir to planned changes in injection strategy, with the possibility of changing these plans if the planned scenario results in a less than optimum recovery of oil and gas.

The method need not be used to replace conventional deterministic reservoir modelling based on the imaged and inferred hydraulic properties of the subsurface. Rather it can be used as a complementary method to check where predictions from such a deterministic method are appropriate, or to highlight areas where the deterministic model needs to be modified.

A key output of trials is the degree to which the Statistical Reservoir Model can highlight the long-range correlations consistent with geo-mechanical effects, and hence whether such calculations are necessary in a given oilfield. The present invention is found to highlight the strong directionality of the flow field, notably the strong alignment of the well pairs identified by the binary significance matrix with the direction of maximum principal stress (for tensile displacement) or the two orthogonal Coulomb slip orientations (for incipient shear failure).

The geographical distribution of the principal components of the matrix show a strong correlation with the location and orientation of mapped major faults in reservoirs tested to date, holding out the possibility of identifying both fluid conduits and fluid barriers in conjunction with the system of the present invention.

FIG. 8 shows a general arrangement 20 in which the present invention is used to characterise and control the operation of an oil field.

Data 22 is fed into the analysis means 24 of the present invention. The analysis means performs various statistical and mathematical operations upon the data in order to firstly 26, select an optimal regression model which represents injector and producer wells whose fluid flow characteristics are highly correlated with the fluid flow characteristics of a well of interest.

Bayesian techniques 28 are then applied to identify well pairs that are statistically related to each other in the optimal regression model. A statistical reservoir model 30 is obtained from the product of a significance matrix and the regression model. The analysis means 24 will allow the determination of strategies for the management of flow by control means.

Where the model 32 is output from the analysis means 24, the model 32 is used in an oil field operation 34. The effectiveness of the operation is optimised 36 through application of data derived from the analysis means.

FIG. 9 shows an apparatus in accordance with the present invention. The apparatus 40 comprises a computer system 42 with a data input for receiving production data. The analysis module 46 contains a set of program instructions which analyse the production data and control means provides control instructions for operating one or more well in response to the output of the analysis module 46. The control instructions of the control means 48 provide an output 50 to a well 52. The control instructions may be adapted to allow the well to be closed down for maintenance, or as part of a "sweep" strategy or to optimise production, for example.

The present invention may be used in the planning of enhanced, improved or optimised recovery of oil and gas. Petroleum engineers can use the present invention to predict reservoir response to a planned injection strategy, in order to determine what strategies will provide optimal recovery.

The oil field operation may include designing 'sweep' strategies where flow rate at the injectors is increased in a controlled way, or optimising maintenance schedules where wells are shut down for a time.

In addition, the present invention provides a measure of the long range effects that a change in a well will produce on other wells and can allow better well management and flow optimisation.

The structural information provided by the present invention would help with several common operational questions, such as identifying where stress-related geomechanical effects were important, where existing faults and fractures play a major role in the subsurface flow regime between well pairs, in identifying channeled or baffled flow (including identifying so called 'super-permeability' zones), and to better condition conventional reservoir models at the subsurface scale using more accurate geostatistical realisations.

Yet another application is that by extrapolating data between existing injectors and producers, an in-fill strategy can be devised, drilling and adding new producers in locations which will optimise overall reservoir production, and prevent bypassed pockets of stored hydrocarbon.

The method may also be used in conjunction with other independent data sets, for example in examining two-point correlations in micro-seismicity associated with shear failure in the subsurface, both to minimise hazard and to infer the mechanism of epicentre diffusion (hydraulic, geo-mechanical or both).

Improvements and modifications may be incorporated herein without deviating from the scope of the invention.

The invention claimed is:

1. A computer system for modelling hydrocarbon reservoir behaviour to manage fluid flow within the reservoir, the computer system comprising:

an analysis module usable by said computer system and having computer readable program code embodied therein, said computer readable program code adapted to be executed to cause the computer system to analyse oil field production data by executing program instructions which comprise an optimal regression model which represents both injector and producer wells whose fluid flow characteristics are correlated with the fluid flow characteristics of a well of interest, execute program instructions which apply information criteria to identify well pairs whose flow rate and pressure data statistically contribute information to the optimal regression model, and execute program instructions which obtain a statistical reservoir model whose elements are the product of corresponding elements in the optimal regression model and a significance matrix where the significance matrix statement is made upon the matrix of the significance test $-N_{i,j}=1$ where the well pairs fluid flow characteristics are statistically significant as a consequence of their contributing information to the optical regression model, otherwise $N_{i,j}=0$; and a control for modifying the reservoir fluid flow at one or more wells of interest to manage fluid flow in response to the statistical reservoir model of the analysis module.

2. The system as claimed in claim 1, wherein the control controls the throughput of one or more wells.

3. The system as claimed in claim 1, wherein the control controls the sweep or pattern of injection into an injector well.

4. The system as claimed in claim 1, wherein the control is adapted to identify the position of and subsequently control, in-fill wells.

5. The system as claimed in claim 1, wherein the control is adapted to automatically control the one or more wells.

6. The system as claimed in claim 1, wherein the control is adapted to control the injection of at least one fluid into a reservoir.

7. The system as claimed in claim 6, wherein the fluid is Carbon Dioxide.

8. The system as claimed in claim 1, wherein the information criteria comprise Bayesian analysis.

9. The system as claimed in claim 1, wherein the significance matrix is a binary significance matrix.

10. The system as claimed in claim 1, wherein a multiple linear regression model is utilised to establish the optimal regression model for injector and producer wells.

11. The system as claimed in claim 10 wherein the multiple linear regression model;

(e) defines a predictive mean squared error model for a predetermined lag time;

(f) minimizes the predictive mean squared error to obtain a formal multiple linear regression model;

(g) searches for the optimal regression model by a proposed best model selection strategy, wherein the strategy is an automatic forward searching of the model space in a predetermined manner through all possible well pairs, using a modified Bayesian Information Criterion (BIC); and (h) obtains the optimal regression model when (a) the coefficient of determination ($R^2$) exceeds a given value while BIC is still increasing (b) $R^2$ is decreasing or (c) a given number of iterations is reached.

12. The system as claimed in claim 11, wherein the lag time is one-month.

13. The system as claimed in claim 11, wherein the model with the largest BIC value and the increased coefficient of determination ($R^2$) simultaneously are selected.

14. The system as claimed in claim 1, wherein a full Bayesian analysis is applied to a Bayesian Dynamic Linear Model (DLM), based on Markov Chain Monte Carlo (MCMC) methods, wherein the DLM has the same injector and producer wells whose fluid flow characteristics are significantly correlated with the fluid flow characteristics of the well of interest (predictors) as the ones identified in the optimal regression model.

15. The system as claimed in claim 14, wherein the full Bayesian analysis further comprises:

(h) defining the Bayesian DLM, wherein the DLM model has the same injector and producer wells whose fluid flow characteristics are significantly correlated with the fluid flow characteristics of the well of interest (predictors) as the ones identified in the optimal regression, with the corresponding error terms mutually independent and normally distributed with zero mean and finite variances;

(i) applying a prior distribution assumption for unknown parameters for the DLM model where the corresponding variances possess chi-squared distributions;

(j) applying a likelihood function of the unknown parameters;

(k) calculating the joint posterior densities of the unknown parameters;

(l) calculating the corresponding full conditional densities of each parameter in the models;

(m) applying a Gibbs sampler algorithm to obtain the full posterior densities of the unknown parameters in a straightforward way; and (n) obtaining the significance matrix by the posterior density of slope coefficient that if the posterior density of slope coefficient is centred at zero, then the coefficient is assigned a value of zero, otherwise the coefficient is one.

16. The system as claimed in claim 14, wherein the Bayesian DLM takes the specific form of a quadratic growth model, in which the error terms correspond to level, growth and change of growth of the underlying process of pressures at time t.

17. The system as claimed in claim 14, wherein the mathematical method of determining the Markov-Chain Monte-Carlo Dynamic Linear Model includes the Gibbs sampler method.

18. The system as claimed in claim 1, wherein the optimal regression model obtained from the multiple linear regression model takes the form of a matrix of elements consisting of real numbers.

19. The system as claimed in claim 1, wherein the significance matrix is obtained from a full Bayesian analysis and is a matrix of elements that can be zero or one.

* * * * *

UNITED STATES PATENT AND TRADEMARK OFFICE

CERTIFICATE OF CORRECTION

PATENT NO. : 8,417,496 B2
APPLICATION NO. : 12/085059
DATED : April 9, 2013
INVENTOR(S) : Ian Main et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 487 days.

Signed and Sealed this
Eleventh Day of June, 2013

Teresa Stanek Rea
*Acting Director of the United States Patent and Trademark Office*